United States Patent [19]

Lindee

[11] 4,243,466

[45] Jan. 6, 1981

[54] LABELING APPARATUS

[75] Inventor: Scott A. Lindee, Mokena, Ill.

[73] Assignee: Sterling Manufacturing, Inc., Westmont, Ill.

[21] Appl. No.: 53,221

[22] Filed: Jun. 29, 1979

[51] Int. Cl.[3] ..... B65C 9/40

[52] U.S. Cl. ..... 156/363; 53/291; 53/585; 156/443; 156/566

[58] Field of Search ..... 53/291-297, 53/580, 582, 585, 592, 139.3; 156/399, 86, 443, 446, 423, 350, 351, 362-363

[56] References Cited

U.S. PATENT DOCUMENTS

| | | | |
|---|---|---|---|
| 2,644,628 | 7/1953 | Gunter et al. | 53/292 |
| 2,976,661 | 3/1961 | Bagnelle | 53/585 X |
| 3,850,777 | 11/1974 | Mare et al. | 53/585 |
| 3,861,118 | 1/1975 | Muto | 53/292 X |
| 4,078,360 | 3/1978 | Balzer et al. | 53/296 X |
| 4,102,728 | 7/1978 | Smith | 53/297 X |
| 4,118,915 | 10/1978 | Swenson | 53/291 |

*Primary Examiner*—David A. Simmons

*Attorney, Agent, or Firm*—McCaleb, Lucas & Brugman

[57] ABSTRACT

A semi-automatic machine for applying sleeve labels to the exterior of flexible walled containers in which individual labels are manually loaded into gripper means which hold and maintain the label in open condition while an unlabeled container is inserted into the label. Throughout the labeling operation the container and the label are at all times positively controlled and held by container clamps and/or the label grippers to insure consistent label application.

9 Claims, 10 Drawing Figures

FIG. 1
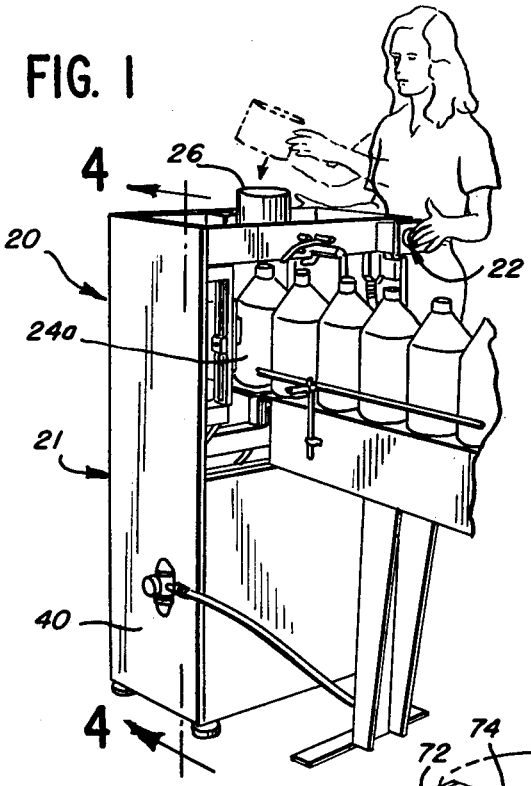
FIG. 2
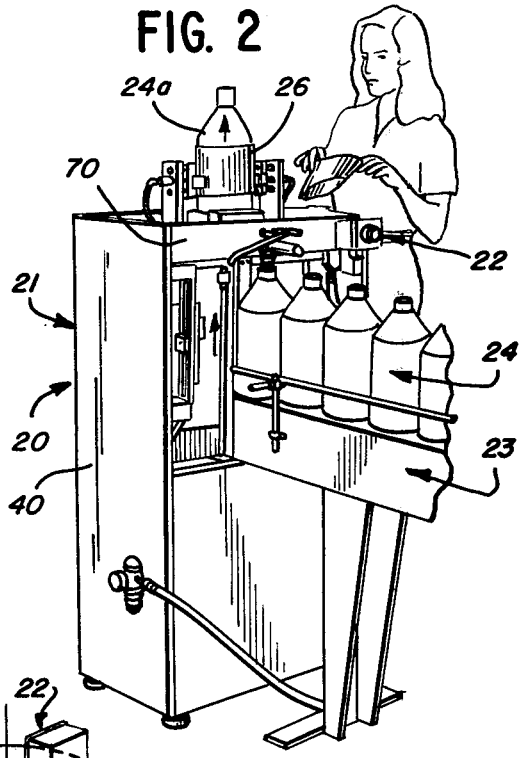
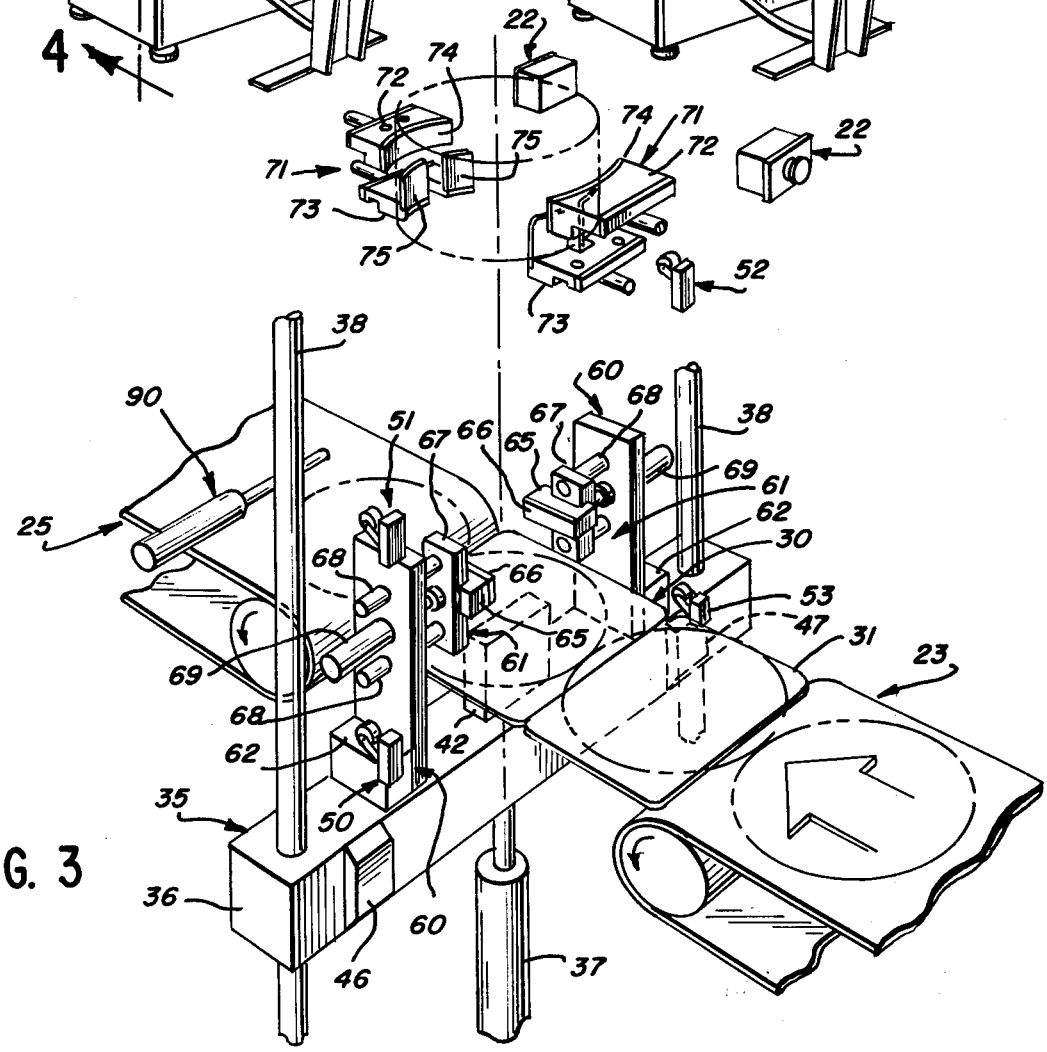
FIG. 3

LABELING APPARATUS

BACKGROUND OF THE INVENTION

Molded flexible wall containers, such as blowmolded plastic bottles, are widely used for packaging a variety of products including various liquids, chemical cleaning agents, antifreeze, petroleum products and the like. Under previous practice, such containers were printed with an appropriate label, usually by employing silk-screen printing techniques. That procedure, however, has given way to a more current program of applying pre-printed labels, formed as endless tubular bands of flexible plastic, capable of being stretched over the exterior of the container.

In U.S. Pat. No. 4,102,728 issued July 25, 1978, a machine for automatically applying such band labels to containers is described in which the band labels are automatically detached from one end of an elongated tubular supply roll; the individual bands being detachably secured to one another by perforation means. As each individual band is detached by the mechanism therein taught, it is pulled downwardly over the exterior of a below-position container and deposited at a desired axial location thereon to accomplish the labeling operation. While labeling machines according to the aforesaid U.S. Pat. No. 4,102,728 have been commercially successful and acceptable for their designed purposes, such are not particularly suited to relatively low volume, short run applications or in instances where frequent label changing is required.

While the aforenoted problem of label changing, and short run production can be met by applying band labels by hand, such an operation is undesirable because of uneconomic consumption of time and labor as well as the inability to make uniform application of the band labels. In addition to the problem of label change it is also to be recognized that container sizes and shapes present a corresponding problem, particularly in low volume applications. Thus automatic equipment which operates at high speeds and high volume application, does not lend itself readily to the low volume production problems met by this invention.

Among the various patents of the prior art which are of interest to the current invention are U.S. Pat. Nos. 3,811,986 issued May 21, 1974; 3,850,777 issued Nov. 26, 1974; 3,792,807 issued Feb. 19, 1974 and the above mentioned U.S. Pat. 4,102,728 issued July 25, 1978.

Of these patents, U.S. Pat. Nos. 3,792,807 and 4,102,728 relate to labeling apparatus in which the band labels are supplied from a continuous roll supply and are automatically severed or detached for application to the containers; U.S. Pat. No. 3,792,807 teaches the adaptation of its automatic label feed system to a manually operated label applying means while U.S. Pat. No. 4,102,728, is also concerned with a fully automated machine which not only automatically separates the band labels from the roll supply, but also automatically applies the same to containers. The other two patents, namely U.S. Pat. Nos. 3,811,986 and 3,850,777, are concerned with label applying devices in which individual labels are manually fed to an applying device and in which containers to be labeled are manually pushed or pulled into an opened label.

SUMMARY OF THE INVENTION

This invention relates to packaging machinery and more particularly to improved apparatus for the semiautomatic application of tubular band labels to containers.

Briefly, the present invention is concerned with mechanical apparatus for automatically orienting and positioning unlabeled containers at a loading station, moving such containers to an opened band label to be applied thereto, inserting the unlabeled container into the opened label and returning the labeled container to the loading station for discharge from the machine.

In addition to the means for automating the movement of the containers, both labeled and unlabeled as noted, the present invention also is concerned with automatic gripper means for grasping and maintaining a band label in position for application by moving a container into the opened label. Such label positioning and holding means are manually supplied with individual labels and are automatically activated to grasp and hold individual labels in position for application to the container, automatically releasing the open label to the exterior of the container in accordance with a predetermined cycle of operation. Safety means are provided to prevent the operator from engaging the automated label gripping and holding means and related mechanisms; such also placing the operational cycle of the machine within the control of the human operator.

It is among the important objects of this invention to provide a semi-automatic label applying apparatus for securing endless band labels about the exterior of unlabeled containers.

It is another important object of this invention to provide improved means for automatically opening a collapsed tubular band label and maintaining the same in position for application to the exterior of a flexible walled container.

It is a further object of this invention to provide semi-automatic labeling equipment for applying tubular band labels about the exterior of a container in which the container's position and movement to and from the labeling station is positively controlled.

It is still another object of this invention to provide a label applying apparatus for the application of band labels about the exterior of a container in which each container is moved to and from a labeling station at which opened labels are applied to containers.

Still another important object of this invention is to provide a labeling apparatus, as set out in the immediate preceding objective, in which the container movement is at all times positively controlled by means which grip the container and maintain the same in a predetermined position throughout the container's movement to the opened label, while the same is being inserted into the open label and while the labeled container is removed from the labeling station.

Having described this invention, the above and further objects, features and advantages thereof will be recognized by those familiar with the art from the following detailed description of a preferred embodiment of its concepts illustrated in the accompanying drawings and representing the best mode presently contemplated so as to enable those of skill in the art to practice this invention.

In the drawings:

FIGS. 1 and 2 are perspective showings of a labeling machine in accordance with the present invention, demonstrating the operational sequencing of loading a band label and applying the same to a container;

FIG. 3 is a partial exploded perspective view illustrating the means for handling a container and holding a label for application to the container;

DESCRIPTION OF THE PREFERRED EMBODIMENT

Figure 4:
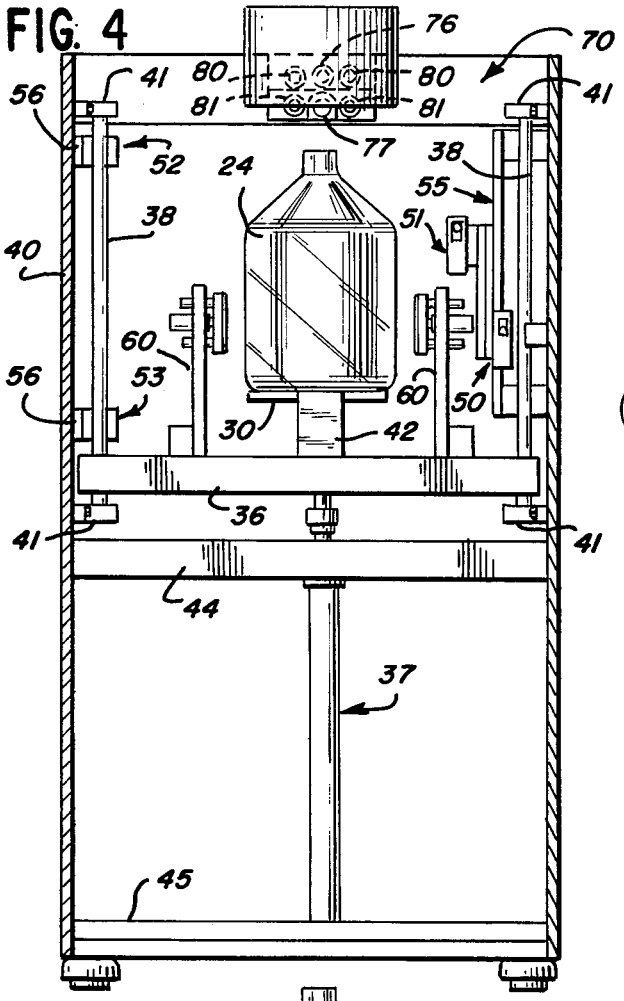
FIG. 4 is a cross sectional view, taken substantially along vantage line 4—4 of FIG. 1.

Turning now to the particulars of the illustrated preferred embodiment, initial reference is made to FIGS. 1 and 2 wherein the general characteristic and operational objectives of this invention are demonstrated. As there shown, a labeling machine, indicated generally at 20, comprises an upright floor mounted machine having a generally rectangular shaped housing 21 protectively enclosing appropriate operating mechanisms and mounting a pair of manually operable control switches 22.

The machine 20 is open on two sides and designed for flow-through operation between the discharge end of a line conveyor 23, carrying unlabeled containers 24, and an appropriate discharge conveyor means 25 (See FIG. 3), for removing labeled containers from the machine.

As shown, machine 20 is intentionally designed for manual feeding of individual band labels 26 over the upper end of the machine; each unlabeled container 24 being moved upwardly through an opened label 26 as the latter is held in coaxial alignment with the upward moving container. It further should be noted from FIG. 1 in particular, that once the operator has placed a label in position for application to a underdisposed unlabeled container 24*a*, the labeling cycle is initiated by manually engaging the pair of control switch means 22 on opposite sides of the machine, thereby automatically removing the operators hands from the label applying area, for safety reasons.

With particular reference now to FIG. 3 of the drawings, the major working elements involved in the container handling and labeling functions are illustrated. It will be noted, for example, that machine 20 is positioned at the end of the supply conveyor line 23, to receive unlabeled containers on a horizontal central loading platform or station 30 disposed in the same plane as the upper run of conveyor 23. The gap between the end of the conveyor 23 and the loading platform 30 preferably is bridged by a dead plate 31.

In a similar manner the discharge of labeled containers is carried out by a motorized discharge conveyor mean 25 having its upper run in a plane common with the loading platform 30 and the upper run of conveyor 23.

It will be recalled that in the basic cycle of operation, an unlabeled container is elevated and thrust through an overdisposed open label which is thereby deposited about the exterior of the container. After the labeling operation, the labeled container is then returned to its initial position at the loading station for subsequent discharge from the machine. To this end, the platform 30 is activated vertically by means of elevator means indicated generally by numeral 35 in FIG. 3. As shown, elevator means 35 comprises a horizontal cross-head 36 of rigid unitary construction which is connected centrally to the upper end of a pneumatic piston and cylinder assembly 37. A pair of parallel spaced, cylindrical guide rails 38, 38, pass through suitable bearing openings (unnumbered) formed adjacent opposite ends of the cross-head 36; the rails 38 guiding the cross-head during its vertical movements in response to operation of the assembly 37. Extension of the piston rod serves to elevate the cross-head 36 and retraction thereof produces reverse on lowering movement of the cross-head.

From FIG. 4 it will be recognized that elevator means 35 is suitably supported between closed, endwall members 40, 40*a* of the housing 21; with the guide rails 38, 38 being carried by projecting support brackets 41, 41 attached to such wall members 40, 40*a*.

Figure 5:
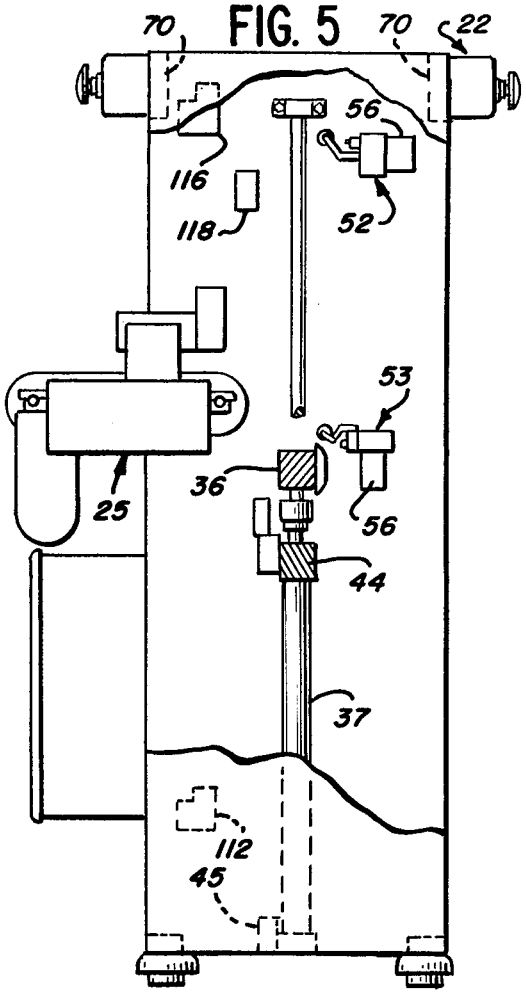
FIG. 5 is a front elevationsl view of the machine illustrated in FIGS. 1 and 2 with portions of the housing broken away to illustrate associated automatic control means.

A central support means is mounted to extend upwardly from the cross-head 36 for undersupporting the loading platform 30. Preferably the support mean 42 is aligned coaxially with the longitudinal axis of the piston and cylinder assembly 37 while the latter is maintained in a vertical upright position between an intermediate support member 44, extending horizontally, substantially medially of the cabinet, and a horizontal base support 45. (See FIGS. 4 and 5).

Adjacent opposite ends of the cross-head and projecting outwardly of one face thereof, are a pair of generally trapazoidal shaped cam blocks 46 and 47 which are aligned to move past plural roller actuated switch means 50, 51, 52 and 53; said switch means 50–53 being individually adjustable vertically on their support mounts to regulate their actuation in relation to the movement cycle of the cross-head, as will be described in greater detail later herein.

As shown in FIG. 4, switch means 50 and 51 are supported on bracket means 55 extending inwardly from the right hand wall member 40*a*, as viewed in that figure. Switch means 52 and 53 are correspondingly supported by bracket means 56 attached to the left hand wall member 40 as therein viewed. As previously noted each of the switch means 50–53 is individually adjustable vertically on its bracket support in order to regulate its operational relationship to the cycling of the elevator means, particularly cross-head 36.

Mounted on the cross-head, on opposite sides of the loading platform 30, are a pair of vertically upright support arms 60, 60 (see FIG. 3) each of which mounts a pneumatically actuated clamp means 61 adapted to grip the exterior of a container therebetween. More specifically each arm 60 is held in its vertical upright position by virtue of a mounting block 62 at its base end which is bolted or otherwise fixed to the upper face of the cross-head 36.

Figure 6:
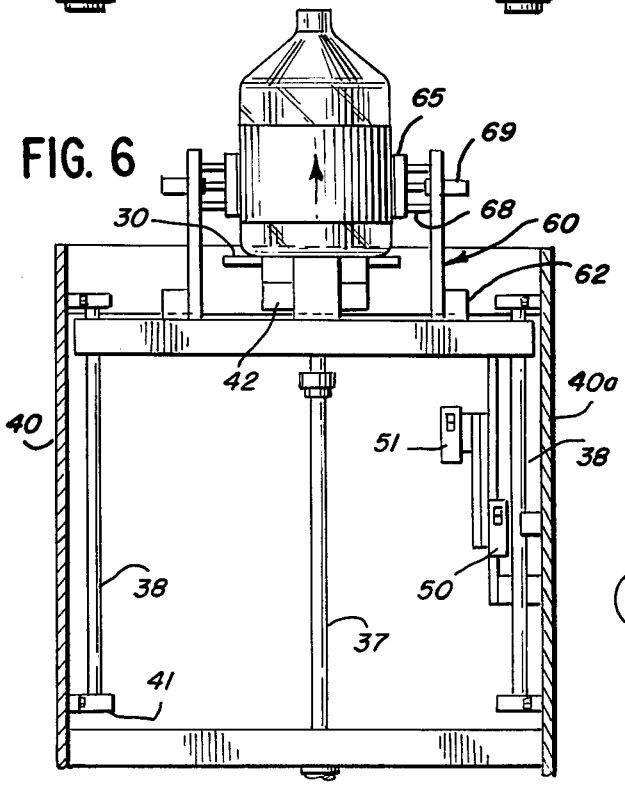
FIG. 6 is a partial elevational view, corresponding to the upper portion of FIG. 4, and illustrating the label applying operation.
Figure 7:
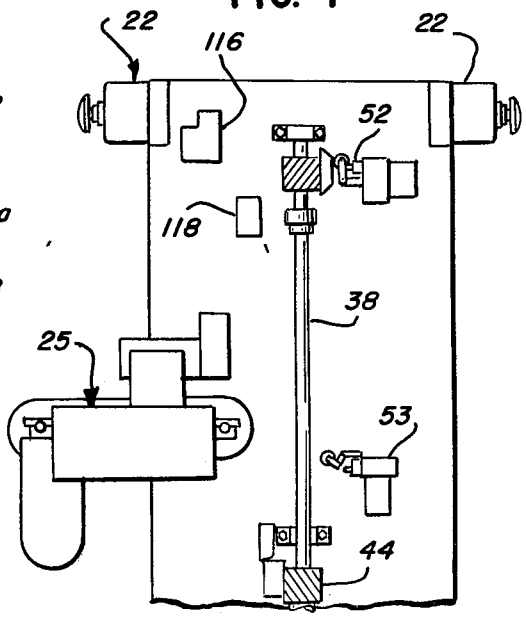
FIG. 7 is a partial elevational view, similar to FIG. 5, illustrating the operational positioning of automatic control means in accordance with the label applying operation illustrated in FIG. 6.

Each clamp mean 61 comprises a central clamp block 65 suitably faced with a sponge rubber pad 66 and movably supported by a guide block 67, which is fitted with a pair of guide pins 68, 68; such two guide pins 68 being disposed in vertical alignment to pass through guide openings formed through an associated vertical arm member 60. A central pneumatic piston and cylinder actuator assembly 69 also is supported on the arm 60 with the piston rod thereof passing through arm 60 and coupled to block 67 for actuating an associated clamp block 65. It will be understood that the two clamp blocks 65 receiprocate in opposite directions along a common axis horizontally above the loading station platform 30 in accordance with the extension or retraction of the piston and cylinder assembly 69, thereby clamping or releasing a container disposed on the platform 30. Specifically each of the actuators 69 is designed so that upon pneumatic actuation, the piston extends, closing the two clamp means toward one another to grip a container therebetween, with opening movement thereof being affected by return spring means. The clamped and released condition of the container clamp means are illustrated respectively in FIGS. 4 and 6 of the drawings.

Figure 8:
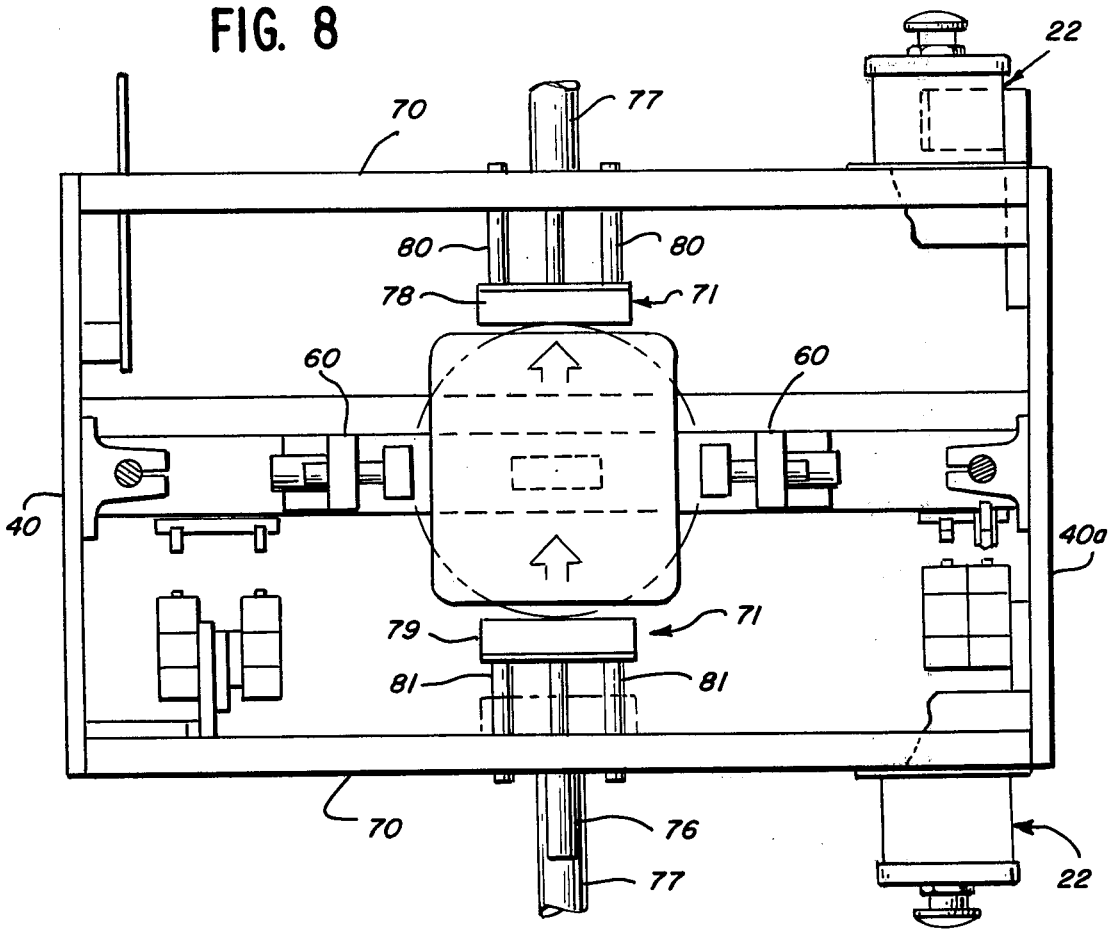
FIG. 8 is an enlarged top plan view of the apparatus illustrated in FIGS. 1 and 2, showing the disposition of container and label gripping means.

Located above the elevator cross-head and container clamp means and supported between parallel side frame members 70, 70 at the upper end of the machine, are label gripper means comprising a pair of laterally spaced, individually actuated gripper assemblies 71, 71 (see FIGS. 3 and 8), which provide the labeling station for the machine. Each assembly 71 comprises a pair of relatively movable superposed gripper members 72 and 73; member 72 comprising a block having an arcuate front wall faced with a resilient pad member 74, while member 73 comprises a movable base having a pair of relatively thin upstanding metal finger portions 75, 75 at a leading edge thereof. The two members 72 and 73 are supported for relative reciprocating movement and are actuated to grip a label therebetween by means of pneumatic piston and cylinder means 76 and 77 (see FIG. 8). Movement of the gripper members in an opening direction is by return spring means (not shown) similar to the arrangement employed with the container clamp means heretofore described. Specifically members 72 and 73 are carried by undersupporting movable mounting blocks 78 and 79, guided by pins 80 and 81, respectively, which pass through the cabinet frame members 70 (see FIG. 8). It will be recognized that the label gripper assemblies are located substantially centrally of the upper end of the machine and are oriented for movement along an axis at right angles to the axis of opening and closing movement for the container clamp means.

In operation each of the members 72 and 73 of a label gripper assembly 71 is movably actuated by its associated pneumatic piston and cylinder means in a label gripping direction and in an opposite or label releasing direction being by the return spring means. The cooperation of the associated pad and finger members on each side of a label 26 serves to hold the latter open in generally cylinderical condition coaxially above a container **24*a* to be labeled so that a container may be thrust upwardly through the opened label and applied to the container. In their non-energized position the label gripper means are open for reception of the lower margin of a label after which the grippers are closed to hold the label in response to actuation of the two manual control switch means 22, as illustrated in FIG. 1**.

It will be appreciated that while the upstanding finger portions 75, 75 of the label gripper assemblies are herein shown as semi-arcuate, thin metal projections to accommodate generally cylindrical shaped labels for application to cylindrical containers as shown, other shape containers may be handled by the herein described apparatus as well. To that end, the finger portions 75 may take other shapes such as linear, semi-oval or the like, depending on the exterior configuration of the container to be treated.

Figure 9:
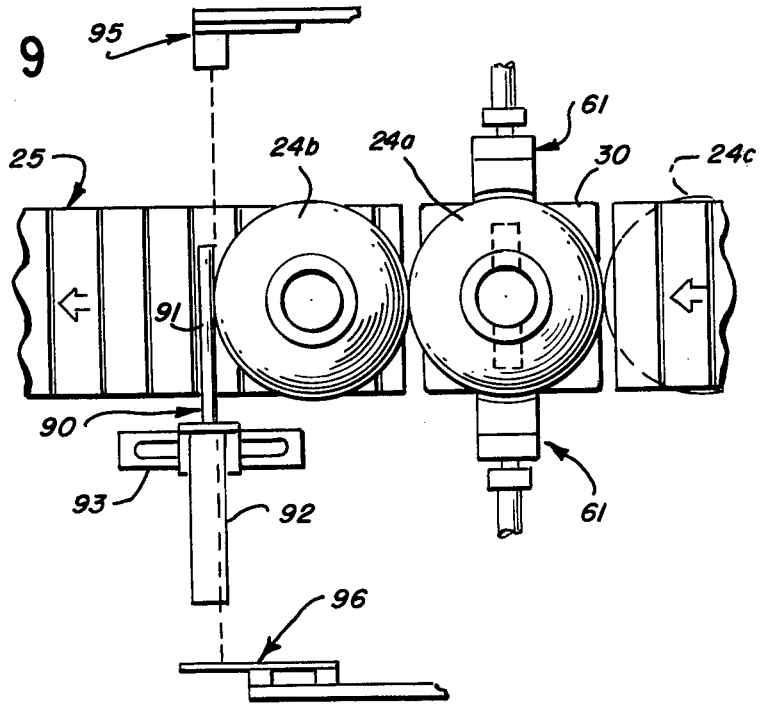
FIG. 9 is an enlarged partial top plan view of the container loading station and associated container handling means.

In addition to the container clamp means and label gripper assemblies described, the containers are further controlled by a pneumatically actuated stop gate means 90, as shown in FIG. 9, which is disposed adjacent the discharge conveyor means 25, to extend transversely across the upper flight of the conveyor. The stop gate is positioned to locate one labeled container **24*b* between a container 24*a* at the loading station 30 and the stop means 90. More specifically, stop means 90 has a movable stop member 91, actuated by piston and cylinder means 92, and mounted on an adjustment bracket 93, whereby member 91 may be positioned at various distance from the loading station (see FIG. 9). Cooperating with the stop member 91 is a photocell assembly 95 located on one side of the conveyor means 25 for cooperation with reflective mirror means 96 located on the opposite side of the conveyor means. The photocell 95 and its reflective mirror 96 are adjusted so that the light beam strikes the leading edge of the container 24*b* engaged against stop member 91, as shown in FIG. 9. So positioned the following unlabeled container 24*a* is centrally located on the loading platform 30**.

Once a container **24*a* has been elevated to an open label and returned to the loading station, the stop member 91 is retracted, releasing the previously labeled container 24*b* for discharge. A newly labeled container at the loading station is then advanced against the stop gate, thus permitting the infeed of an additional unlabeled container 24*c* onto the loading station from line conveyor 23. Adjustment of both the stop means 90** and the photocell and its reflective mirror means is required to accommodate different sizes and shapes of containers handled in a machine of the order herein described.

USE AND OPERATION

Figure 10:
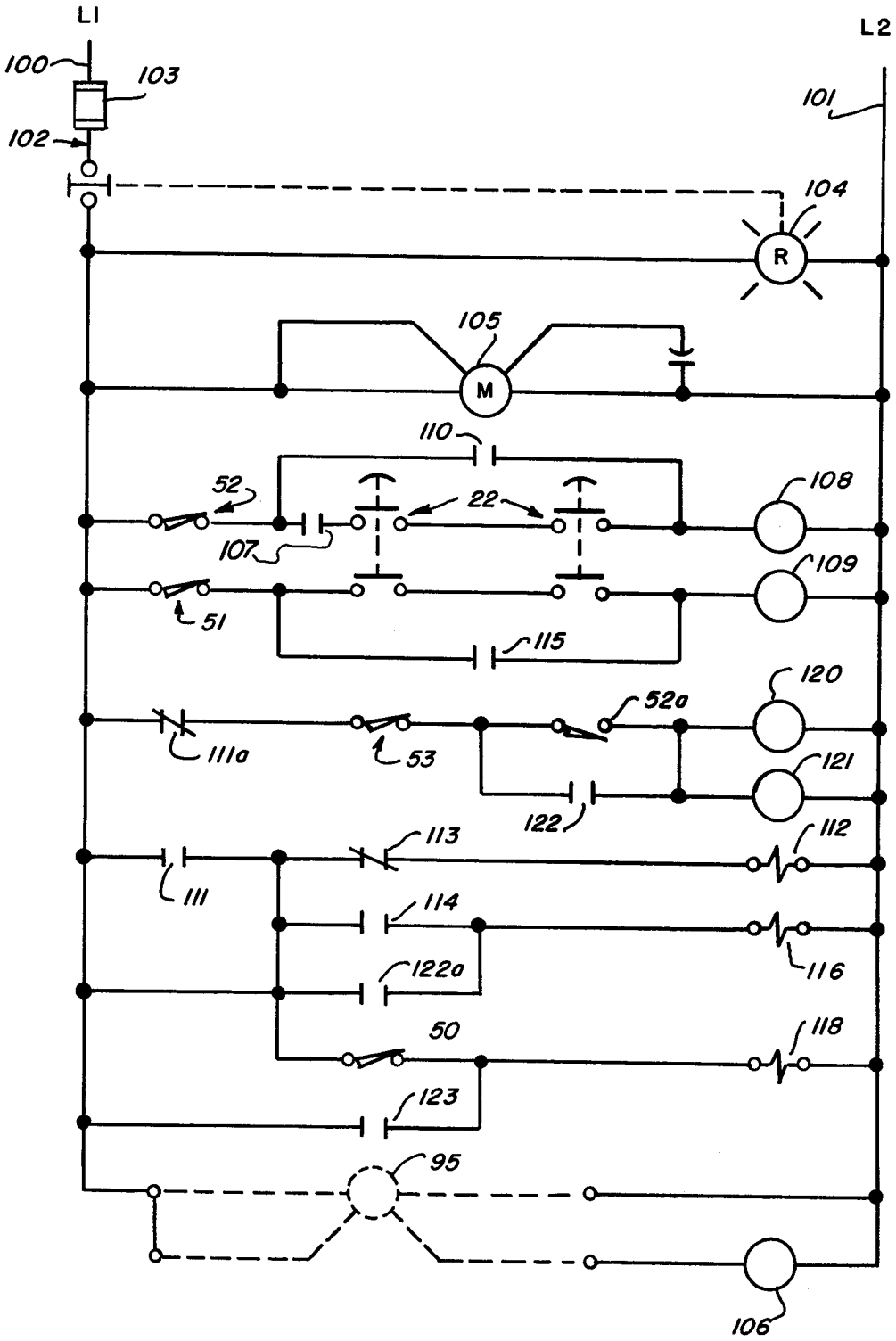
FIG. 10 is a schematic circuit diagram of electrical control circuitry involved in the apparatus of this invention.

Turning now to the operational aspects of the hereinabove described machine, particular reference is made to FIG. 10 where various electrical controls involved in the sequencing of the described means and mechanisms, are depicted. Typically, the control circuit is supplied from a 120 volt, 60 cycle, AC power source over line conductors 100, 101, a main line power control switch 102, protective line fuse 103 and ready light 104. Closing of the master control switch 102 serves to energize a drive motor 105 associated with the discharge conveyor means 25 and the photocell assembly 95.

As containers enter the machine from the incoming supply conveyor 23, the lead container is stopped by the closed stop gate means 90 which is controlled by a independent control switch (not shown) responsive to movements of the elevator means. When the first container breaks the photocell circuit, it energizes an associated holding circuit relay 106 and closes contacts 107 in circuit with the manually operated push-button control switches 22, 22. The machine is now ready for label application, at which stage the operator manually places a label in the label gripper means 71, 71 and depresses the two manual control switches 22, 22 in circuit with closed switch means 51 and 52 thereby energizing control relays 108 and 109.

Energizing relay 108 opens its normally closed contact set 111*a* and closes its normally open contact set 110 and 111 and closing contacts 110 establishes a holding circuit around switches 22. A solenoid operated valve 112, associated with the elevator cylinder and piston assembly 37 is also energized over the closed relay contacts 111, and normally closed relay contacts 113. This causes the elevator means, and particularly the cross-head 36 thereof, to be raised.

Energizing relay 109 serves to close normally open contact sets 114 and 115, the latter of which establishes a holding circuit around the normally open control switches 22. Closing of contact sets 114 serves to energize an associated solenoid valve 116 to actuate the cylinder and piston assemblies 76 and 77 of the label gripper fingers, closing the same to grip and hold a label in open position for application to a container moving upwardly therethrough. A third solenoid valve means 118, in circuit with normally closed cam operated switch means 50, also is energized to provide the clamping operation of the container clamp means 61 thereby an unlabeled container on the loading platform 30 is tightly clamped in position for movement upwardly with the elevator.

As the elevator raises the cross-head, cam plate 46 eventually engages and opens the roller switch means 50, de-energizing solenoid valve 118 and causing the clamp means 61 to momentarily release their grip on the container therebetween. As cam 46 leaves switch means 50, the container clamp regrip the container. Meanwhile switch means 51 is engaged by the cam means 46, de-energizing control relay 109 and its associated contact sets 114, and 115. This serves to open the label gripper means 71, 71 releasing the label for deposit on the container which frictionally strips the label from the grippers as the container moves upwardly through the label. When the elevator reaches the top of its stroke, cross-head cam plate 47 engages the double acting switch means 52, opening the first stage thereof and closing its second stage 52*a*. This serves to de-energize control relay 108, closing contacts 111*a* to energize control relays 120 and 121. Energizing relay 120 closes its normally open contact sets 122 and 122*a*, the latter establishing a holding circuit for relay 121 around switch section 52*a* to hold the label grippers 71, 71 closed. Energizing relay 121, also closes its contact set 123 to re-energize valve means 118, causing the container clamp means 61 to regrip the container.

During this evolution, the upward movement of the elevator means is sufficient for the label engaged by the container to be stripped from and moved upwardly past the open gripper fingers, following which the gripper fingers are closed, and the container clamps sequentially re-energized to reclamp the container and sleeve label thereon as noted. Importantly, during the period when the clamp means are open, releasing the container, the latter is frictionally engaged and held between the opened gripper means, specifically by the finger portions 75 thereof.

De-energization of control relay 108 and opening of its associated contacts 110 and 111, de-energizes the elevator solenoid valve 112, permitting the elevator to fall gravitationally downward, thereby pulling the gripped labeled container downwardly through and between the closed label gripper fingers and returning the now labeled container to its initial loading position.

When the elevator cross-head nears the bottom of its stroke, control switch 53 is struck by plate cam 47, opening such switch to de-energize control relays 120 and 121 and their contacts 122, 122*a* and 123. This opens the label gripper assemblies and container clamps, releasing the labeled container so that the next incoming container is fed onto the loading platform 30, pushing the newly labeled container in front of it.

As the elevator cross-head 36 falls downwardly, it also engages a control switch (not shown) to retract the stop gate means, releasing the labeled container 24*b* thereagainst (see FIG. 9) and permitting the same to be discharged from the machine via conveyor 25. Thus, as the newly labeled container 24*a* reaches its original loading position, as illustrated in FIG. 4 for example, the container against stop 90 is released whereafter the newly labeled container 24*b* is moved against the stop gate 90, which has been returned to its blocking condition as shown in FIG. 9.

It will be recognized that the machine is now reconditioned for the next succeeding labeling cycle.

In order for a label to be properly positioned and deposited at the desired axial position on the container, adjustment of the control switch 51 is necessary. It will be recalled that switch 51 and the other switch assemblies 50, 52 and 53 are mounted on vertically adjustable bracket means. By raising the position of switch 51, placement of the label on the container is lowered and visa-versa. Correspondingly the limit of the upward movement for the elevator cross head may be adjusted by appropriate positioning of the switch means 52. Thus, the labels may be adjustably positioned on the containers as desired.

From the foregoing it is believed that those familiar with the art will readily recognize and appreciate the advancement represented by the present invention and will understand that while the same has been described herein in relation to a preferred embodiment illustrated in the accompanying drawings, the same is the subject to obvious modifications, changes and substitutions of equivalents without departing from the scope of the disclosed invention.

The embodiments of the invention in which an exclusive property or privilege is claimed are defined as follows:

1. Apparatus for applying band labels to containers comprising: loading station means including a horizontal platform receptive of individual unlabeled containers, elevator means operable to elevate and lower said platform vertically between loading and labeling positions, clamp means mounted adjacent said platform for movement therewith and operable to hold individual containers in label receiving position on said platform, manually loaded label gripper means located remotely above said platform and operable to grip and hold a band label in stationary open condition substantially coaxially over a container on said platform, power actuated means for individually actuating said gripper means, clamp means and elevator means; control means for operating said power actuated means in predetermined sequence whereby to hold a label in open container receptive position above said platform, to elevate said platform and move an unlabeled container thereon upwardly through said open label, to open said gripper means and release said label to the exterior of said container as the latter moves upwardly therethrough, and to lower the labeled container to its original elevation at said loading station; power actuated conveyor means mounted adjacent said platform and having the upper run thereof in coplanar relation with said platform for receiving labeled containers discharged therefrom in the lowered position of said elevator means, and periodically actuated stop gate means extending across said conveyor means for interrupting the movement of containers therealong; said stop gate means being positioned to locate an unlabeled container centrally of said platform when a previously labeled container is stopped against said gate means.

2. The combination of claim 1 wherein said clamp means comprise a pair of power actuated clamping members disposed in laterally spaced positions and operable to reciprocate linearly along a common axis to firmly clamp and release a container therebetween.

3. The combination of claim 1 wherein said control means comprises plural switch means operatively responsive to vertical movement of said elevator means and disposed in vertically spaced positions along the movement path thereof.

4. The combination of claim 3 and cam means, carried by said elevator means, for periodically engaging said switch means whereby to operate the same.

5. The combination of claim 3, and adjustable mounting means supporting said switch means and operable to locate the latter at selected vertical positions whereby to regulate the operational cycling thereof in relation to vertical movements of said elevator means.

6. The combination of claim 1, wherein said gripper means are normally open for manual insertion of a band label thereinto, and a pair of manually actuated control switch means, located remotely of said gripper means and operable for controlling closing operation of said gripper means and initiation of a labeling cycle.

7. The combination of claim 1 wherein said control means are operable to open said clamp means and release said container held thereby as said clamp means are elevated to a position approaching interferring engagement with a band label held in said gripper means, and wherein said gripper means are subsequently opened to release a band label to the exterior to a container being moved upwardly therethrough; said gripper means being closed as a band label is released to the container and remaining closed until the labeled container is lowered therepast.

8. The combination of claim 7, and finger portions on said gripper means, disposed within a band label held thereby and operable in the open position of said gripper means to engage the exterior of a container whereby to hold the latter on said platform when said clamp means have released the same during the label depositing function.

9. The combination of claim 6, and photocell means associated with said gate means and operably responsive to the presence of a container against said gate means to enable operating circuitry associated with said manually actuated switch means.

* * * * *